US006080058A

United States Patent [19]

Coe et al.

[11] Patent Number: 6,080,058

[45] Date of Patent: Jun. 27, 2000

[54] HOOD DOOR AIRFOIL

[75] Inventors: Jotham W. Coe, Niantic; Daniel P. Brannegan, Mystic, both of Conn.

[73] Assignee: Pfizer Inc., New York, N.Y.

[21] Appl. No.: 09/098,314

[22] Filed: Jun. 16, 1998

Related U.S. Application Data

[60] Provisional application No. 60/060,159, Sep. 26, 1997.

[51] Int. Cl.[7] ..... B08B 15/02

[52] U.S. Cl. ..... 454/56; 312/209; 422/104

[58] Field of Search ..... 422/99, 104; 312/209; 454/56, 57, 59

[56] References Cited

U.S. PATENT DOCUMENTS

| | | | |
|---|---|---|---|
| 3,340,788 | 9/1967 | Landingham et al. | 454/59 |
| 3,726,206 | 4/1973 | Worick, Jr. | 454/56 |
| 3,752,056 | 8/1973 | Chamberlin et al. | 454/59 |
| 4,177,718 | 12/1979 | Grow et al. | 454/59 |
| 5,556,331 | 9/1996 | Bastian | 454/56 |

FOREIGN PATENT DOCUMENTS

| | | | |
|---|---|---|---|
| 978413 | 11/1975 | Canada | 454/59 |
| 3939063 | 5/1991 | Germany | 454/56 |
| 2086035 | 5/1982 | United Kingdom | 454/59 |

*Primary Examiner*—Mark Spisich
*Attorney, Agent, or Firm*—Peter C. Richardson; Gregg C. Benson; A. Dean Olson

[57] ABSTRACT

An apparatus for directing the flow of air in a laboratory-type hood. A laboratory hood is provided with a closure sash and the lower edge of the closure sash has an airfoil that extends into the laboratory hood work space.

1 Claim, 2 Drawing Sheets

HOOD DOOR AIRFOIL

This application claims priority from provisional application U.S. Ser. No. 60/060,159 filed Sep. 26, 1997, the benefit of which is hereby claimed under 37 C.F.R. 1.78(a)(3).

BACKGROUND OF THE INVENTION

This invention relates generally to air handling systems and particularly to laboratory-type hoods.

The accepted method employed for controlling laboratory air contamination and potential exposures of laboratory personnel to toxic, hazardous or radioactive materials is the laboratory exhaust hood (i.e. fume hood). The main purpose of a laboratory hood is to confine air contamination within the hood working area so that contaminant concentrations in the air in the workers' breathing zone outside of the hood face are well below the threshold limit values. Thus it is possible for potentially dangerous experiments and tests to be carried out with relative safety.

Originally, laboratory hoods consisted of a working chamber having an open front and means in the form of a suction fan above the open chamber for drawing air through the opening to carry any undesirable gases or other substances from the chamber. Many of the original hoods also incorporated some type of transparent shield that could be utilized to enclose the opening while the laboratory test was being conducted.

With the advent of air conditioning in most facilities, withdrawing such large amounts of air-conditioned air from the room became extremely costly. As a result (to alleviate some of these problems) supplemental air from the atmosphere surrounding the building has been drawn in and utilized to provide a curtain of air across the hood face. Contamination originating within the hood is not only prevented from escaping the hood into the room by the hood exhaust but is also forced to remain in the hood by a positive supply air barrier. This double protection and clean air supply provide significantly improved protection from hood contamination losses caused by high room air convection and poor hood location. However, in order for an air flow barrier to provide maximum effective worker protection from hazardous hood contamination, the air velocity must be adequate and uniform over the hood face with a velocity vector essentially perpendicular to the plane of the hood face opening. The air velocity at the open face of the hood increases inversely proportionally to the size of the hood face opening as the sash is lowered.

Unfortunately, high face velocities and excessive turbulence are particularly undesirable for several reasons, including contamination of chemicals, equipment, and samples being analyzed, interference with burners and chemical reactions, and uncontrollable loss of toxic or radioactive materials. Safety of the operator is, of course, of paramount consideration.

Thus, there is a continuing need and a continuing search in this field of art for laboratory hood configurations that, for example, improve hood efficiency, especially in regards to worker exposure, and which minimize air curtain velocities in order to maintain a safe working area.

SUMMARY OF THE INVENTION

This invention is directed to an apparatus which directs air through a laboratory hood housing.

The apparatus comprises a laboratory hood comprising:

a work surface and an internal work space covering the work surface;

a housing covering the work space and an opening for gaining access to the work space;

a movable closure sash that extends downward to the work surface and operatively connects with the housing, the closure sash adapted to move from an open position wherein access to the work space may be gained to an enclosing position wherein the closure sash mates with the work surface and cooperates with the housing in confinement of the work space;

the said closure sash having a lower edge that substantially mates with the work surface in the closed position and the closure sash having an air foil extending inward to the work space;

means for providing a substantially vertical downward air curtain across the opening for circulating air through the work space while accommodating both enclosing confinement of the work space and opening thereof, the means positioned above the open area and outward from the closure sash; and means for exhausting air from the work space through the housing.

Alternatively, the housing has an airfoil that extends across the opening and inward from the closure sash to the work space. In this embodiment, the airfoil is slidably mated to the closure sash.

This apparatus provides a significant improvement to the chemical industry by facilitating the reduction of chemicals external to an enclosed chemical work area (e.g., lab hood) while allowing potential for the reduction in hood air flow.

Other features and advantages will be apparent from the specification and claims and from the accompanying drawings which illustrate embodiments of the invention.

DETAILED DESCRIPTION OF THE INVENTION

Figure 1:
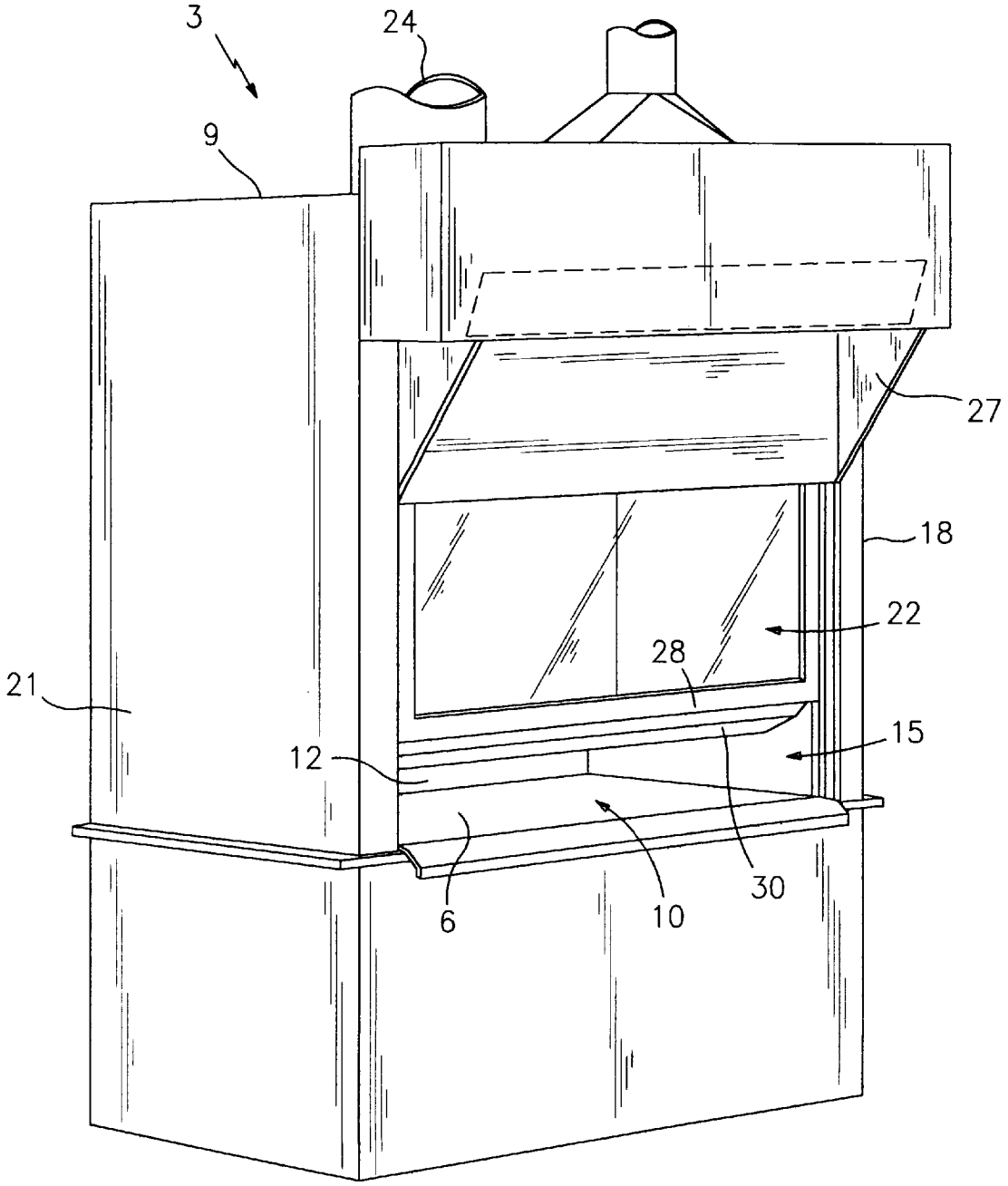
FIG. 1 is a schematic view (in perspective) of a lab hood including an airfoil.

According to FIG. 1 a laboratory hood housing 3 has vertically spaced and horizontally elongated top and bottom walls 6,9 in which the bottom wall 6 is a laboratory work surface. A work space 10 is disposed above the laboratory work surface 6. The housing 3 has a horizontally elongated upright back wall 12 and an open or openable front side 15 (hood face), the latter being joined by upright side end walls 18,21.

A movable closure sash 22 extends downward to the work surface and operatively connects with the housing side walls 18, 21 via, for example, suitable tracks. The closure sash 22 is adapted to move from an open position wherein access to the work space 10 may be gained to an enclosing position wherein the closure sash 22 mates with the work surface 6 and cooperates with the housing 3 in confinement of the work space 10.

A means for directing a curtain of air (i.e., auxiliary air curtain supply), such as a wide conduit 27, generally of a width equal to the openable front side 15, is mounted above the hood face and is supplied with air under superatmospheric pressure. Optionally an air bypass may be used when the sash 22 is at least partially closed to maintain air flow. The air curtain supply is operative to direct auxiliary air outside of the closure sash 22 downward along the hood face 15 to facilitate circulation of air through the work space 10 (e.g., substantially vertically downward in a substantially uniform laminar flow). Thus, the auxiliary air accommodates both enclosing confinement of work space 10 and opening thereof as it is directed beneath the movable closure sash 22, when it is open, and above the closure sash 22 through the bypass as the closure sash 22 is lowered and closed.

As is standard in the art, typically, the air is not taken from inside the laboratory, although a certain amount of laboratory air must inherently be exhausted to completely eliminate the possibility of leakage into the laboratory, but can be drawn in from outside. The use of a wide curtain also allows relatively low velocities to be employed, so that the extinguishing of Bunsen burners or other inadvertent interference with experiments or tests is avoided.

A means for exhausting air from the work space 10 through the housing such as an outlet 24 in the top wall 9 that may extend generally the full length of the top wall 9 is included. Optionally, the air may exhaust via gaps or vents along rear vertical wall 12.

The closure sash 22 has a lower edge 28 that substantially mates with the work surface 6 in the closed position. The closure sash 22 has an air foil 30 extending inward to the work space. Typically, the airfoil 30 extends along the whole length of the closure sash 22.

The airfoil 30 directs air and contaminant flow from within the hood working area 10 substantially inward, away from the laboratory user particularly the breathing area. The airfoil has many benefits. For example, it facilitates the flow of air and contaminant that occurs within the work area 10, behind the sash closure 22, toward the back of work area 10. In the absence of the airfoil 30 the sash lower edge 28 can direct the circular flow of gasses to the users face. In contrast, the airfoil redirects air inward creating a zone of lower pressure, much like an eddy current, thus causing an acceleration of fresh room or make-up air from behind and above the laboratory user into the zone of lower pressure. The resulting increase in clean air at the breathing zone enhances safety and provides the potential for decreased overall air flow through the work area 10.

Further, manufacture of the airfoil 30 and its connection component and sash edge 28 with an opaque chemically inert material allows improved vision for the laboratory user. In addition, since the edge of the sash is displaced further into the hood, access to distant objects within the working space 10 is improved.

Figure 2:
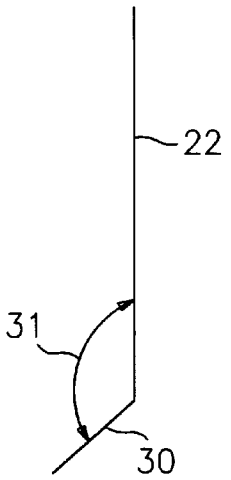
FIG. 2 is a schematic view (in cross-section) of an exemplary fixed angle airfoil of this invention.

According to FIG. 2 the airfoil 30 may have a fixed angle 31 with respect to the closure sash 22. Preferably, the airfoil forms an angle of about 120 degrees to about 135 degrees with respect to the closure sash. This angle range facilitates the promotion of an eddy away from the space in front of the closure sash 22 thus, clearing the air around the laboratory user space. Alternatively, the airfoil may have an adjustable angle with respect to the closure sash 22. The angle adjustment may be made to work in cooperation with the height of the closure sash for optimized effect.

Preferably, the ratio of the length of the airfoil to the maximum hood vertical opening is about 1 to about 10. In a particularly preferred embodiment the airfoil extends about two inches to about four inches from the closure sash 22.

Figure 3:
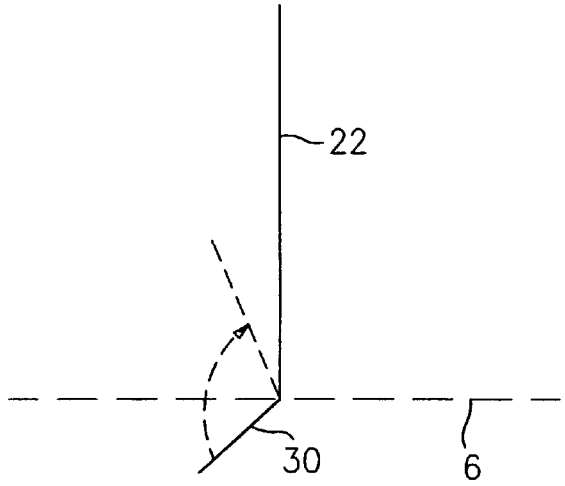
FIG. 3 is a schematic view (in cross-section) of an exemplary hinged airfoil of this invention.

Alternatively, according to FIG. 3 the airfoil 30 may be hinged (e.g., springably hinged) to the closure sash 22 to allow for upward retraction of the airfoil 30 when the closure sash 22 is in the fully closed position so that the closure sash mates with the work surface 6.

Figure 4:
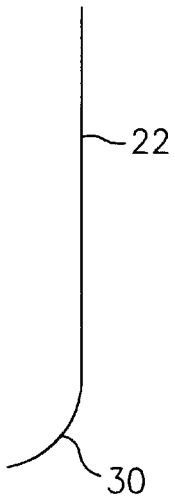
FIG. 4 is a schematic view (in cross-section) of an exemplary fixed angle curved airfoil of this invention.

Alternatively, according to FIG. 4 the airfoil 30 may be an integral extension of the closure sash 22 that extends in a curvilinear fashion from the closure sash 22 downward and inward to the work space 10.

Figure 5:
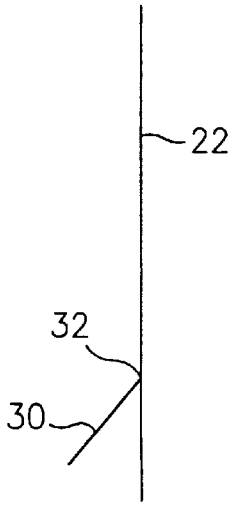
FIG. 5 is a schematic view (in cross-section) of an exemplary airfoil that is slidably sealed to a hood front closure.

According to FIG. 5 in a further embodiment the airfoil 30 extends across the opening 15 and inward from the closure sash 22 to the work space 10 however, instead of being attached to the closure sash 22 the airfoil 30 is slidably sealed (i.e., mated) to the closure sash 22 at point 32. In this embodiment the airfoil 30 may be fixed or provision may be made for an upward or downward adjustment of the airfoil 30 depending upon the position of the closure sash 22. Provision may also be made for an adjustment of the angle of the airfoil 30 with respect to the closure sash 22.

The airfoil 30 may be made of, for example, an opaque chemically inert material (e.g., safety glass) or stainless steel. A glass airfoil facilitates laboratory use since it would not obstruct vision when the closure sash 22 is partly open.

It should be understood that the invention is not limited to the particular embodiments shown and described herein, but that various changes and modifications may be made without departing from the spirit and scope of this novel concept as defined by the following claims.

What is claimed is:

1. A laboratory hood comprising:

a. a work surface and an internal work space covering said work surface;

b. a housing covering said work space and an opening for gaining access to said work space;

c. a movable closure sash that extends downward to the work surface and operatively connects with the housing, said closure sash adapted to move from an open position wherein access to said work space may be gained to an enclosing position wherein said closure sash mates with said work surface and cooperates with said housing in confinement of said work space;

d. said closure sash having a lower edge that substantially mates with said work surface in the closed position and said closure sash having an air foil extending inward to the work space, said airfoil hinged to the closure sash allowing for the adjustment of the airfoil angle depending upon the position of the closure sash and with respect to the angle of the airfoil with the closure sash;

e. means for providing a substantially vertical downward air curtain across said opening for circulating air through the work space while accommodating both enclosing confinement of said work space and opening thereof, said means positioned above said opening and outward from the closure sash; and f. means for exhausting air from said work space through said housing.

* * * * *